US011130010B2

(12) United States Patent
Inoue et al.

(10) Patent No.: US 11,130,010 B2
(45) Date of Patent: Sep. 28, 2021

(54) INJECTION HEAD FOR LIQUEFIED FIRE-EXTINGUISHING AGENT

(71) Applicant: Koatsu Co., Ltd., Hyogo (JP)

(72) Inventors: Yasufumi Inoue, Hyogo (JP); Masahiro Yabushita, Hyogo (JP); Mitsunori Kamo, Hyogo (JP)

(73) Assignee: KOATSU CO., LTD., Hyogo (JP)

( * ) Notice: Subject to any disclaimer, the term of this patent is extended or adjusted under 35 U.S.C. 154(b) by 93 days.

(21) Appl. No.: 16/609,525

(22) PCT Filed: May 15, 2018

(86) PCT No.: PCT/JP2018/018699
§ 371 (c)(1),
(2) Date: Oct. 30, 2019

(87) PCT Pub. No.: WO2018/212160
PCT Pub. Date: Nov. 22, 2018

(65) Prior Publication Data

US 2020/0139174 A1 May 7, 2020

(30) Foreign Application Priority Data

May 19, 2017 (JP) ..... JP2017-099696

(51) Int. Cl.
*A62C 31/02* (2006.01)
*B05B 1/34* (2006.01)
(Continued)

(52) U.S. Cl.
CPC ..... *A62C 31/02* (2013.01); *A62C 99/0018* (2013.01); *B05B 1/14* (2013.01); *B05B 1/34* (2013.01); *B05B 15/40* (2018.02)

(58) Field of Classification Search
CPC ..... A62C 31/02; A62C 99/0018; B05B 1/34; B05B 1/14; B05B 15/40
(Continued)

(56) References Cited

U.S. PATENT DOCUMENTS 3,022,014 A * 2/1962 Young ..... B05B 1/185 239/521
5,404,957 A * 4/1995 McCormack ..... A62C 31/12 239/590.3
(Continued)

FOREIGN PATENT DOCUMENTS

EP 1 151 800 11/2001
JP 62-174547 11/1987
(Continued)

OTHER PUBLICATIONS

International Search Report dated Jul. 17, 2018 in International (PCT) Application No. PCT/JP2018/018699.

*Primary Examiner* — Steven J Ganey
(74) *Attorney, Agent, or Firm* — Wenderoth, Lind & Ponack, L.L.P.

(57) ABSTRACT

An injection head is configured to discharge a liquefied fire-extinguishing agent. The injection head includes an injection head body configured to be connected to piping for supplying the liquefied fire-extinguishing agent; an orifice plate positioned in the injection head body, the orifice plate including orifices defined therein; a block-shaped porous member positioned at an outlet of the orifice plate; and a deflector positioned across from the block-shaped porous member such that a discharging clearance for the liquefied fire-extinguishing agent is defined.

3 Claims, 5 Drawing Sheets

(51) Int. Cl.

| | |
|---|---|
| ***A62C 99/00*** | (2010.01) |
| ***B05B 1/14*** | (2006.01) |
| ***B05B 15/40*** | (2018.01) |

(58) Field of Classification Search
USPC .... 169/11, 37; 239/451, 456, 505, 513–515, 239/518, 520, 521, 524, 553.3, 575, 590.3
See application file for complete search history.

(56) References Cited

U.S. PATENT DOCUMENTS

| | | | | |
|---|---|---|---|---|
| 2011/0259617 | A1 | 10/2011 | Lelic et al. | |
| 2013/0292140 | A1* | 11/2013 | Inoue ..... | A62C 31/02 169/11 |
| 2014/0069663 | A1 | 3/2014 | Yabushita et al. | |

FOREIGN PATENT DOCUMENTS

| | | |
|---|---|---|
| JP | 2012-70774 | 4/2012 |
| JP | 5276730 | 8/2013 |

* cited by examiner

INJECTION HEAD FOR LIQUEFIED FIRE-EXTINGUISHING AGENT

ART FIELD

This invention concerns injection head for liquefied fire-extinguishing agent with high boiling point such as halogenide.

BACKGROUND ART

In fire-extinguishing equipment, if liquefied fire-extinguishing agent with high boiling point such as halogenide, for example, dodecafluoro-2-methylpentane-3-on ($CF_3CF_2C(O)CF(CF_3)_2$, boiling point 49.2° C., NFPA/ISO registered name FK-5-1-12 is used as the fire-extinguishing agent, the injection head to atomize the liquefied fire-extinguishing agent is used.

But the injection head to atomize the liquefied fire-extinguishing agent was low in diffusivity and vaporizing of the liquefied fire-extinguishing agent, and in addition to the fact that the range subject to fire-extinguishing to cover with one injection head is small, high-level noise was generated when the liquefied fire-extinguishing agent is discharged through the injection head.

OUTLINE OF INVENTION

Problems to be Solved by the Invention

In consideration of the problems of the injection head to be installed to discharge the liquefied fire-extinguishing agent to the range subject to fire-extinguishing in the fire-extinguishing equipment to use the aforementioned liquefied fire-extinguishing agent, the objective of this invention is to provide an injection head for the liquefied fire-extinguishing agent, which is high in diffusing and vaporizing characteristics of the liquefied fire-extinguishing agent and capable of increasing the subject range to be covered with one injection head and also capable of increasing the rate of reducing the noise.

Means to Solve the Problems

In order to achieve the aforementioned objective, the injection head for liquefied fire-extinguishing agent of this invention is an injection head installed to discharge the liquefied fire-extinguishing agent in the fire-extinguishing equipment to use the liquefied fire-extinguishing agent, and it is composed of the injection head to which piping to supply the liquefied fire-extinguishing agent is connected and characterized in that it is equipped with an orifice plate installed to the injection head, a block-shaped porous member installed at the outlet of the orifice, and a deflector installed across the discharging clearances of the fire-extinguishing agent to the porous member.

In this case, it is possible to install a clearance adjusting mechanism to optionally set the discharging clearance of the aforementioned liquefied fire-extinguishing agent.

At least one portion of peripheral face in the flow direction and parallel direction of the liquefied fire-extinguishing agent of the block-shaped porous member can be opened into the atmosphere.

Effect of the Invention

According to the injection head for liquefied fire-extinguishing agent of this invention, the injection head to which piping to supply the liquefied fire-extinguishing agent is connected is equipped with the orifice forming orifice plate installed to the injection head, block-shaped porous member installed at the outlet of the orifice, and the deflector installed across the discharging clearance of the fire-extinguishing agent to the said porous member, and therefore, the liquefied fire-extinguishing agent supplied via the orifice is diffused while flowing in the block-shaped porous member and becomes a large discharging area and collides with the deflector installed across the discharging clearance of the liquefied fire-extinguishing agent to the porous member, thereby able to diffuse and vaporize in a wide range. This makes it possible to obtain good diffusing and vaporizing characteristics and increase the fire-extinguishing subject range to be covered with one injection head.

Since the liquefied fire-extinguishing agent diffuses while flowing in the block-shaped porous member and is discharged in a big discharging area, it is possible to reduce the noise generated when the liquefied fire-extinguishing agent is discharged.

By providing the clearance adjusting mechanism to optionally set the size of the discharging clearance of the liquefied fire-extinguishing agent, the fire-extinguishing subject range that can be covered with one injection head can be easily adjusted.

At least one portion of the peripheral face in the flow direction and parallel direction of the liquefied fire-extinguishing agent of the block-shaped porous member is opened into the atmosphere, and due to the ejector effect by the flow of the liquefied fire-extinguishing agent in the block-shaped porous member, air is taken in from the peripheral face opened into the atmosphere of the porous member, making it possible to promote the diffusion and vaporization of the liquefied fire-extinguishing agent in the porous member.

FORM TO IMPLEMENT THE INVENTION

Below the implementation forms of the injection head for liquefied fire-extinguishing agent of this invention are explained in accordance with the drawings.

Figure 1:
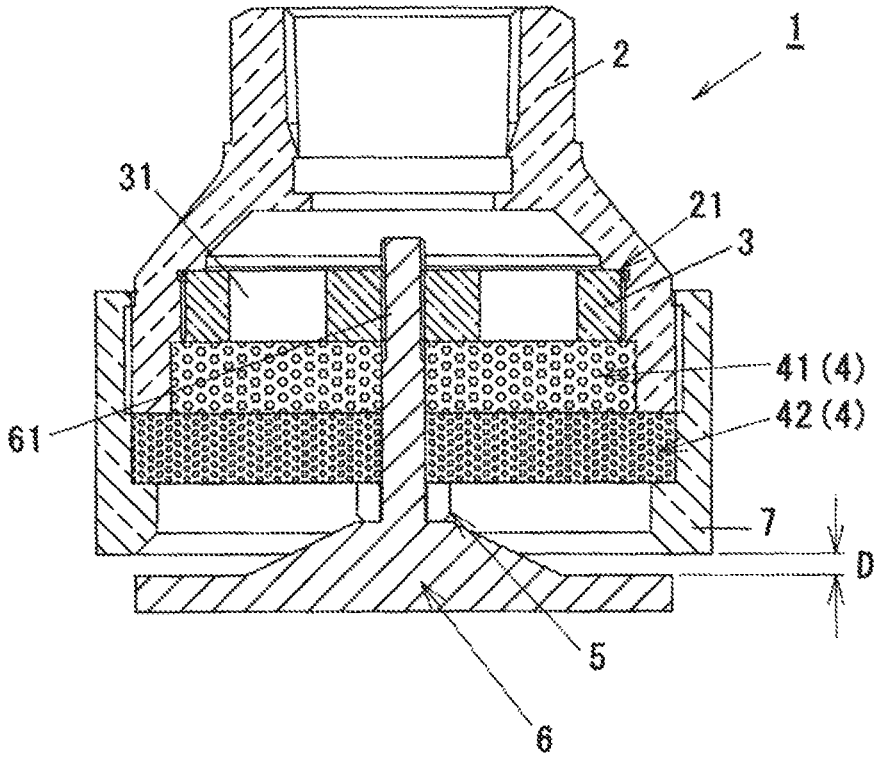
FIG. 1: Cross section to show the first embodiment of the injection head for liquefied fire-extinguishing agent of this invention.

FIG. 1 shows the first embodiment of the injection head for liquefied fire-extinguishing agent of this invention.

This injection head 1 for liquefied fire-extinguishing agent is injection head 1 to be installed to discharge the liquefied fire-extinguishing agent to the fire-extinguishing subject area in the fire-extinguishing equipment to use liquefied fire-extinguishing agent and is equipped with injection head 2 to which piping (illustration omitted) to supply the liquefied fire-extinguishing agent is connected, orifice plate 3 forming orifice 31 installed to the injection head, orifice pate 3 forming orifice 31 installed to the injection head 2, block-shaped porous member 4 installed at the outlet of the orifice 31, and deflector 6 installed across the discharging clearance D of liquefied fire-extinguishing agent to the block-shaped porous member 4.

Figure 5:
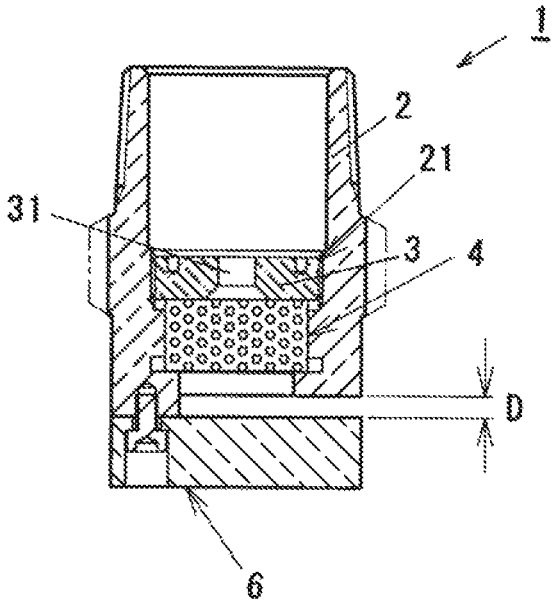
FIG. 5: Cross section to show the fifth embodiment of the injection head for liquefied fire-extinguishing agent.

Here the injection head 1 is formed in a circle with the central axis as rotational symmetry (same is true with the following embodiments) For the injection head 2 to which piping to supply the liquefied fire-extinguishing agent is connected, internal thread (or external thread (the fifth embodiment of the liquefied fire-extinguishing agent of this invention shown in FIG. 5) to connect the piping is formed.

Here the liquefied fire-extinguishing agent, the subject of this injection head 1 for liquefied fire-extinguishing agent, includes the fire-extinguishing agents (1)-(3) below.

(1) Fire-extinguishing agent held as liquid in a storage container in a normally preserved state, for example halogenide fire-extinguishing agent such as halon 1301.

(2) Fire-extinguishing agent in the state of liquid just before the injection head when it is injected from the injection head, for example, HFC-227ea, etc.

(3) Fire-extinguishing agent with the boiling point 0□C or higher, for example, dedocafluoro-2-methylpentane-3-on ($CF_3CR_2C(CF_3)_2$, boiling point 49.2□C, NFPA/ISO registered name FK-5-1-12, etc.

In this case, the orifice plate 3 is of a disk shape with one or more orifices 31 (6 orifices in this embodiment) formed at an equal angle at the center, and it is installed in a removable way to the stepped portion 21 formed in the internal space of the injection head 2, via threads, for example, around the stepped portion 21 and orifice plate 3, thus making it possible to select the orifice plate 31 forming orifices 31 of multiple types in accordance with the condition of installation place, etc.

It is also possible to form the orifices 31 directly on the injection head 2 by omitting the orifice plate 3.

The block-shaped porous member 4 can be formed either as an integral structure or divided structure with multiple porous members 41 and 42 laminated as shown in this embodiment.

For the block-shaped porous member 4, an inorganic material (metal, metallic oxide or hydroxide) high in shape retaining performance, that is, not so easily deformed by the discharge pressure of the liquefied fire-extinguishing agent can be suitably used or a porous metallic material consisting of three-dimensional mesh structure (Cellmet (?) (registered tradename of Sumitomo Electric Industries) can be more suitably used.

As for the void diameter of the porous member 4, a material generally uniform is used, to be more specific, the material to be sequentially changed along the flow direction of the liquefied fire-extinguishing agent can be used, and in this embodiment, for example, the void diameter of the porous material 41 on the upstream side of the flow direction of the liquefied fire-extinguishing agent is smaller than that of the porous member 42 on the downstream side.

By decreasing the void diameter of the porous member 4 along the flow direction of the liquefied fire-extinguishing agent as aforementioned, it is possible to uniformly diffuse the liquefied fire-extinguishing agent to flow in the block-shaped porous material.

As for the porous member 4, in either case of integral structure or divided structure, the end face on one side of the porous member 4 is installed in contact with the injection head 2 (orifice plate 3 may be included in this embodiment) and the end face on the other side of the porous member 4, except for the portion in contact with the ring member 7 (the ring member 7 is installed spirally to the injection head 2) to fix the porous member 4 to the threaded portion 61 (central portion) to be described later and injection head 2, is opened into the atmosphere. This makes it possible to take a large discharging area of the liquefied fire-extinguishing agent opened into the atmosphere of the porous member 4, thus increasing the rate to reduce the noise.

The deflector 6 installed across the discharging clearance D of the liquefied fire-extinguishing agent to the porous member 4 can be composed of threaded portion 61 to pass through the porous member 4 (threaded portion 61 is formed integrally with the deflector 6 or different member (bolt) can be formed). If the threaded portion 61 is composed of bolts, one bolt or multiple bolts can be used. Thus it is spirally installed to the orifice plate 3 (or the threaded portion 61 is composed of bolts and nuts 8 and fastened to the orifice plate 3 (third embodiment of the injection head for liquefied fire-extinguishing agent of this invention shown in FIG. 3) thus fixing and making it integral with the injection head 2.

The face of the deflector 6 with which the discharged liquefied fire-extinguishing agent collides is made angular in this embodiment but can also be made flat as shown in the following embodiment.

The discharging clearance D of the liquefied fire-extinguishing agent is controlled by the thickness of spacer 5 as the clearance adjusting mechanism provided between the porous member 4 and deflector 6, and by properly selecting the spacer 5 different in thickness, the size of the discharging clearance D of the liquefied fire-extinguishing agent can be optionally set. This makes it possible to easily adjust the fire-extinguishing subject range that can be covered with one injection head 1.

Figure 2:
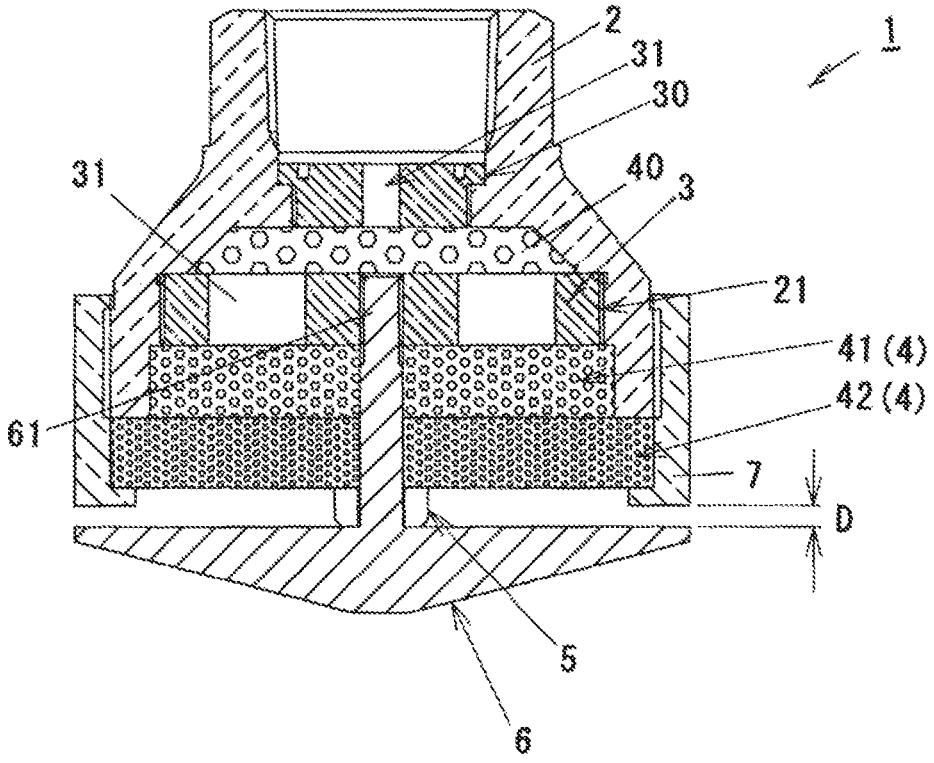
FIG. 2: Cross section to show the second embodiment of the injection head for liquefied fire-extinguishing agent of this invention.

By the way, in this embodiment, a space is provided at the upper part of the orifice plate 3 in the injection head 1, and as shown by the second embodiment of the injection head for liquefied fire-extinguishing agent of this invention shown in FIG. 2, it is possible to provide the second orifice plate 30 and second block-shaped porous member 40 in this space.

In this case, the second orifice plate 30 has one orifice 31 formed at the center and is spirally installed to the injection head 2.

For the second porous member 40, it is preferable to use a material in which the void diameter becomes larger than that of the porous member 4.

Figure 3:
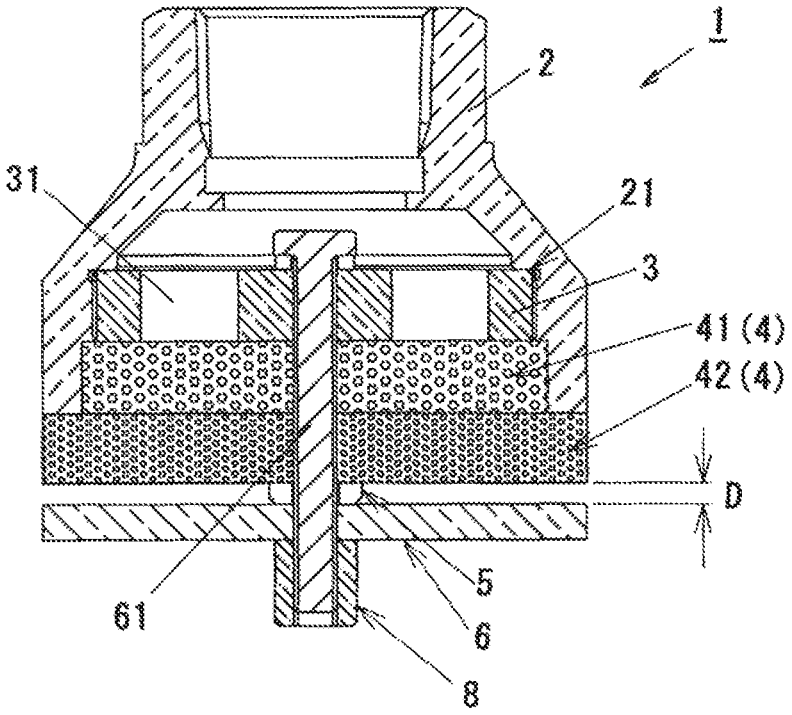
FIG. 3: Cross section to show the third embodiment of the injection head for liquefied fire-extinguishing agent of this invention.
Figure 4:
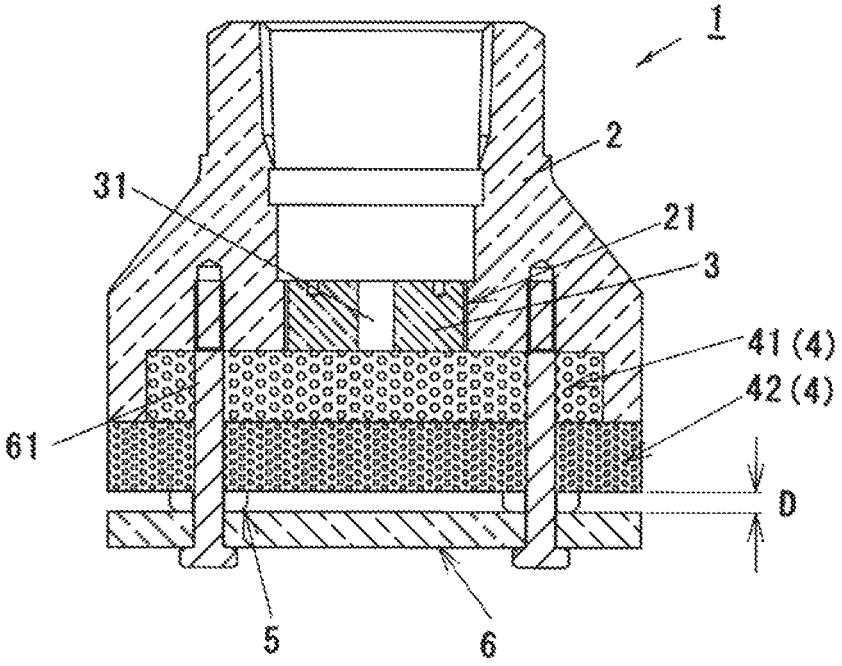
FIG. 4: Cross section to show the fourth embodiment of the injection head for liquefied fire-extinguishing agent of this invention.

As in the embodiments 3 and 4 of the injection head for liquefied fire-extinguishing agent of this invention shown in FIGS. 3 and 4, at least one part of the outer periphery (outer periphery of the porous member 42 in this embodiment) of the flow direction and parallel direction of the liquefied fire-extinguishing agent is opened into the atmosphere.

By this, air is taken in from the outer periphery opened into the atmosphere due to the ejector effect due to the flow of the liquefied fire-extinguishing agent in the block-shaped porous member 42, and the diffusion and vaporizing of the liquefied fire-extinguishing agent is promoted in the porous member 42.

As in the fifth embodiment of the injection head for liquefied fire-extinguishing agent of this invention shown in FIG. 5, in the case of the small injection head 1, the deflector 6 is attached to the injection head 2, thereby making it possible to form the discharging clearance D for liquefied fire-extinguishing agent having directional properties.

According to the injection head 1 for liquefied fire-extinguishing agent so far described above, it is equipped with the injection head 2 to which piping to supply the liquefied fire-extinguishing agent is connected, orifice plate 3 forming orifices 31 installed to the injection head 2, block-shaped porous member 4 installed at the outlet of the orifices 31, and the deflector 6 installed across the discharging clearance D of liquefied fire-extinguishing agent to the porous member 4, and so the liquefied fire-extinguishing agent supplied via the orifices 31 is diffused to become a large discharging area while flowing in the block-shaped porous member 4 and collides with the deflector 6 installed across the discharging clearance D of liquefied fire-extinguishing agent to the porous member 4, thereby making it possible to diffuse and vaporize over a wide range. This makes it possible to obtain good diffusing and vaporing characteristics of the liquefied fire-extinguishing agent and increase the fire-extinguishing subject range that can be covered with one injection head 1.

Since the liquefied fire-extinguishing agent is diffused to become a large discharging area while flowing in the block-shaped porous member 4 and then discharged, it is possible to reduce the noise produced when the liquefied fire-extinguishing agent is discharged.

The injection head for liquefied fire-extinguishing agent of this invention has so far been explained in accordance with multiple embodiments, but this invention is not limited to the configuration described in the above embodiments and it can be properly changed within a range not deviating from the tenor.

Possibility of Industrial Use

Since the injection head for liquefied fire-extinguishing agent of this invention has good diffusing and vaporizing properties making it possible to increase the fire-extinguishing subject range that can be covered with one injection head and reduce the noise, it can be widely used for injection heads to be installed to discharge the liquefied fire-extinguishing agent to subject areas in the fire-extinguishing equipment to use the liquefied fire-extinguishing agent and its application is not limited to new fire-extinguishing equipment and it can also be applied for existing fire-extinguishing equipment by just changing the injection head.

EXPLANATION OF SIGNS

1: injection head
2: injection head proper
21: stepped portion
3: orifice plate
30: orifice plate
31: orifices
4: porous member
40: porous member
41: porous member
42: porous member
5: spacer
6: deflector
61: threaded portion (bolt)
7: ring member
8: nut
D: discharging clearance

The invention claimed is:

1. An injection head configured to discharge a liquefied fire-extinguishing agent, the injection head comprising:

an injection head body configured to be connected to piping for supplying the liquefied fire-extinguishing agent;

an orifice plate positioned in the injection head body, the orifice plate including orifices defined therein;

a block-shaped porous member positioned at an outlet of the orifice plate; and a deflector positioned across from the block-shaped porous member such that a discharging clearance for the liquefied fire-extinguishing agent is defined, wherein:

the block-shaped porous member is configured to promote diffusion and vaporization of the liquefied fire-extinguishing agent;

a flat end face of the block-shaped porous member is configured to discharge the liquefied fire-extinguishing agent such that the liquefied fire-extinguishing agent collides with a face of the deflector; and the face of the deflector is flat.

2. The injection head of claim 1, further comprising a clearance adjusting mechanism configured to set a size of the discharging clearance for the liquefied fire-extinguishing agent.

3. The injection head of claim 1, wherein at least one portion of an outer periphery of the block-shaped porous member is open to an atmosphere in an axial direction of the injection head and a radial direction of the injection head.

* * * * *